US006286703B1

(12) United States Patent
Munro

(10) Patent No.: US 6,286,703 B1
(45) Date of Patent: Sep. 11, 2001

(54) RESEALABLE DRINK CAN

(76) Inventor: Laurie Munro, 30 Bardwell Drive Mickleham, Melbourne, Victoria 3064 (AU)

( * ) Notice: Subject to any disclaimer, the term of this patent is extended or adjusted under 35 U.S.C. 154(b) by 0 days.

(21) Appl. No.: 09/551,261

(22) Filed: Apr. 18, 2000

Related U.S. Application Data

(63) Continuation-in-part of application No. 09/109,197, filed on Jul. 2, 1998, now abandoned.

(51) Int. Cl.[7] ..... B25D 17/34
(52) U.S. Cl. ..... 220/269; 220/240
(58) Field of Search ..... 220/269, 240, 220/359.2

(56) References Cited

U.S. PATENT DOCUMENTS 2,860,814 * 11/1958 Duemler ..... 220/378 X
3,486,665 * 12/1969 Croce ..... 222/480
3,738,526 * 6/1973 Zundel et al. ..... 220/269 X
3,952,914 * 4/1976 Vogt ..... 220/269 X
4,411,370 * 10/1983 Rausing ..... 220/269
4,442,950 * 4/1984 Wilson ..... 220/269
4,463,866 * 8/1984 Mandel ..... 220/269
4,582,216 * 4/1986 Byrd ..... 220/260
4,673,099 * 6/1987 Wells ..... 220/269
5,035,343 * 7/1991 Morton ..... 220/270
5,121,851 * 6/1992 Lyon et al. ..... 220/268
5,242,073 * 9/1993 Willis et al. ..... 220/240

* cited by examiner

*Primary Examiner*—Stephen K. Cronin

(57) ABSTRACT

A resealable drink can is provided including an end plate for closing one end of the can. The end plate defines a first surface which in use faces an inside of the container and a second surface which in use faces an outside of the end plate. The end plate further has at least one aperture formed therein. A closure plate is mounted on the end plate on a pivot located adjacent to the aperture on a first side of the end plate. A handle is disposed on a second side of the end plate and is operatively connected to the closure plate such that movement of the handle moves the closure plate about the pivot.

9 Claims, 3 Drawing Sheets

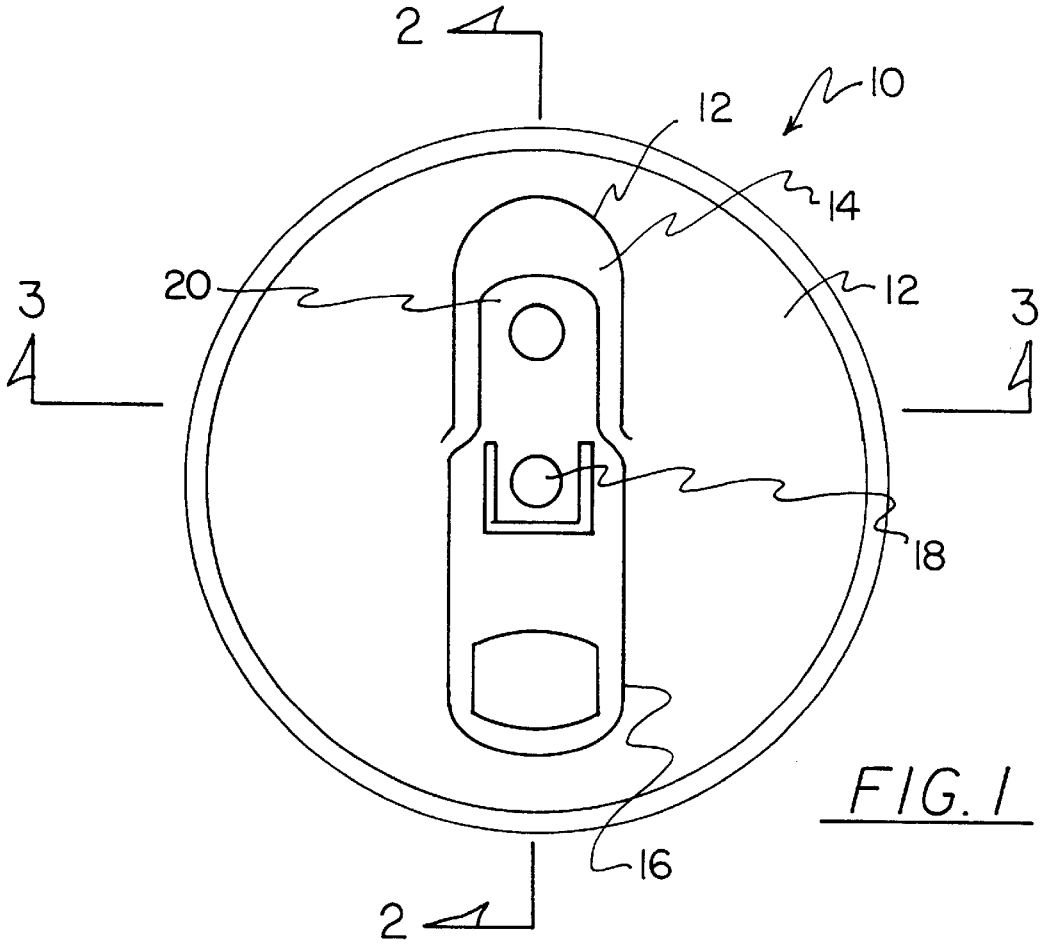
FIG. 1
FIG. 2a
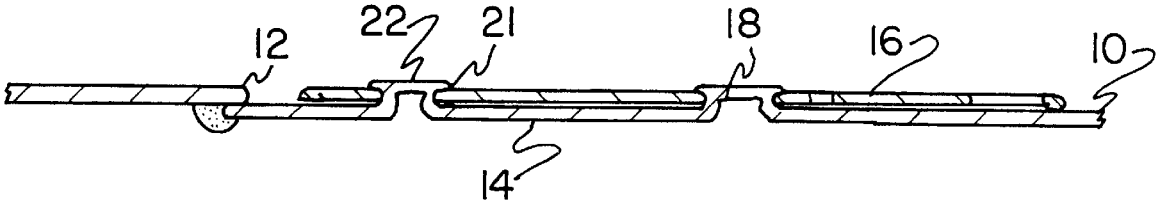

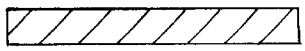
FIG.4a
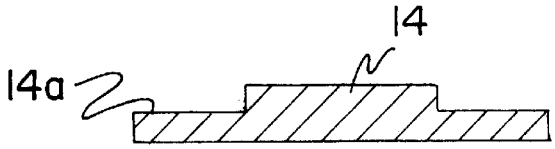
FIG.4b
FIG.5a
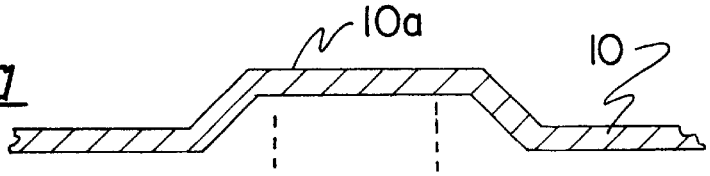
FIG.5b
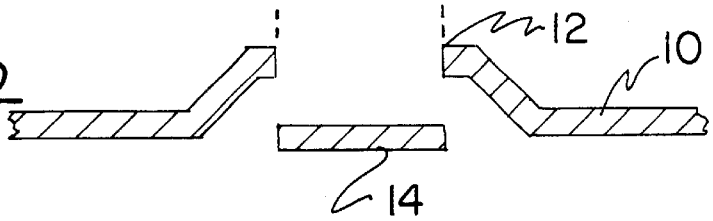
FIG.5c
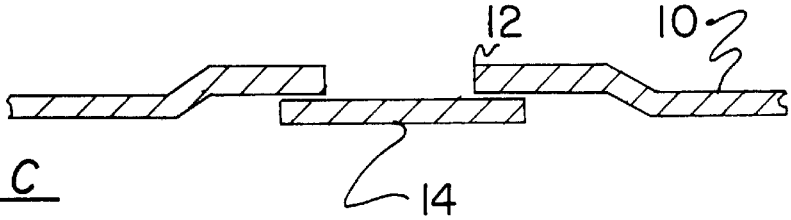

RESEALABLE DRINK CAN

CROSS REFERENCE TO RELATED APPLICATION

This application is a continuation-in-part of Application Ser. No. 09/109,197, filed Jul. 2, 1998, now abandoned.

BACKGROUND OF THE INVENTION

1. Field of the Invention

The present invention relates to drink cans and more particularly pertains to a new resealable drink can for allowing a drink can to be closed and sealed after it has been opened.

2. Description of the Prior Art

The use of drink cans is known in the prior art. More specifically, drink cans heretofore devised and utilized are known to consist basically of familiar, expected and obvious structural configurations, notwithstanding the myriad of designs encompassed by the crowded prior art which have been developed for the fulfillment of countless objectives and requirements.

Beverages such as beer and carbonated soft drinks have been sold in tubular cans, made from aluminum or steel, for many years. Early tubular cans were mostly used for beers and lagers. In early can design, both ends of the can were planer, and to open the can, one or typically two, holes were pierced in one end of the can to allow beer to pour out from one hole, and to allow air to enter the other hole to equalize the pressure in the can. The major disadvantage with that design was that can openers were required to open the cans.

The next development was in the invention of the ring pull can end in which a tear drop shaped weakened portion was formed in one end of the can. The perimeter of the tear drop shaped portion had a substantially reduced thickness and a handle or pull was attached to the tear drop shaped potion which could be used to pull the tear drop shaped portion away from the can end to define a tear drop shaped opening for pouring beverage from the container.

The ring pull design was highly successful, however the design had one major drawback, in that when the can was opened the ring pull became separated from the can. This was considered to be a problem in terms of the litter it caused and the original ring pull design is considered to be environmentally unfriendly. The latest development of the ring pull is a can end in which the ring pull or handle pushes the weakened tear drop shaped portion in the can itself, rather than separating that portion from the can end, so that the tear drop shaped portion remains attached to the can.

However all the above mentioned drink can ends share one problem which so far no design has solved, in that whatever opening method is used, they cannot be resealed. This is a substantial disadvantage when compared with bottles with reclosable screw cap type closures, which bottles have traditionally been made of glass but are now often made of plastic.

Known prior art drink cans include U.S. Pat. No. 5,035,343; U.S. Pat. No. 4,673,099; U.S. Pat. No. 5,242,073; U.S. Pat. No. 3,486,665; U.S. Pat. No. 5,121,851; and U.S. Pat. No. 2,860,814.

In these respects, the resealable drink can end according to the present invention substantially departs from the conventional concepts and designs of the prior art, and in so doing provides an apparatus primarily developed for the purpose of allowing a drink can to be closed and sealed after it has been opened.

SUMMARY OF THE INVENTION

In view of the foregoing disadvantages inherent in the known types of drink cans now present in the prior art, the present invention provides a new resealable drink can construction wherein the same can be utilized for allowing a drink can to be closed and sealed after it has been opened.

The general purpose of the present invention, which will be described subsequently in greater detail, is to provide a new resealable drink can apparatus and method which has many of the advantages of the drink cans mentioned heretofore and many novel features that result in a new resealable drink can which is not anticipated, rendered obvious, suggested, or even implied by any of the prior art drink cans, either alone or in any combination thereof.

To attain this, the present invention generally includes an end plate for closing one end of a container, one side of the end plate defining a first surface which in use faces an inside of the container and an second surface which in use faces an outside of the end plate, the end plate further defining at least one through aperture therein; a closure plate hinged to the end plate about a pivot located adjacent to the aperture, the closure plate being larger in area than the aperture, and being disposed on a first side of the end plate and adapted to close the aperture; and a handle which is disposed on a second side of the end plate and which is operatively connected to the closure plate such that movement of the handle moves the plate about the pivot.

By making the closure plate larger than the aperture such that the extreme portions of the closure plate abut the areas of the can end plate adjacent the perimeter of the aperture, pressure in the can forces the closure plate against the end plate and hence increases the strength of the seal. Thus the can is inherently sealed since an increase in the pressure in the can increases the strength of the seal. This contrasts with the prior art ring pull type can where the closure plate is effectively smaller than the aperture defined in the can when the can is opened. In such a design an increase in pressure in the can would merely put increased pressure on the weakened portions around the closure. The use of a handle attached to the closure plate enables the closure plate to be manipulated so that the can may be opened by raising the handle in the same manner as with existing beverage containers. However, in contrast with existing end plates for beverage cans, the handle may also be used to close the container after opening by pushing the handle towards, and flat against, the end plate. If there is sufficient carbonated beverage in the can the pressure in the can increases above atmospheric pressure due to carbon dioxide in the beverage coming out of solution. This increase in pressure may be sufficient to push the closure plate against the aperture thereby providing a satisfactory seal. However, in a preferred embodiment, a plastic sealing material is provided around the perimeter of the closure and the aperture to improve air tightness of the seal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new resealable drink can apparatus and method which has many of the advantages of the drink cans mentioned heretofore and many novel features that result in a new resealable drink can which is not anticipated, rendered obvious, suggested, or even implied by any of the prior art drink cans, either alone or in any combination thereof.

It is another object of the present invention to provide a new resealable drink can which may be easily and efficiently manufactured and marketed.

It is a further object of the present invention to provide a new resealable drink can which is of a durable and reliable construction.

An even further object of the present invention is to provide a new resealable drink can which is susceptible of a low cost of manufacture with regard to both materials and labor, and which accordingly is then susceptible of low prices of sale to the consuming public, thereby making such resealable drink can end economically available to the buying public.

Still yet another object of the present invention is to provide a new resealable drink can which provides in the apparatuses and methods of the prior art some of the advantages thereof, while simultaneously overcoming some of the disadvantages normally associated therewith.

Still another object of the present invention is to provide a new resealable drink can for allowing a drink can to be closed and sealed after it has been opened.

Even still another object of the present invention is to provide a new resealable drink can that includes an end plate for closing one end of the can. The end plate defines a first surface which in use faces an inside of the container and a second surface which in use faces an outside of the end plate. The end plate further has at least one aperture formed therein. Next provided is a closure plate hinged to the end plate about a pivot located adjacent to the aperture on a first side of the end plate. A handle is disposed on a second side of the end plate and is operatively connected to the closure plate such that movement of the handle moves the closure plate about the pivot.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of an end plate of the present invention.

FIG. 2*a* is a cross-sectional view taken along line 2—2 shown in FIG. 1 showing the plate in a closed position.

FIGS. 4*a* and 4*b* illustrate a method of enlarging the closure plate of the present invention.

FIGS. 5*a* through 5*c* illustrate a method of reducing the size of the aperture relative to the closure plate.

DESCRIPTION OF THE PREFERRED EMBODIMENT

Figure 2B:
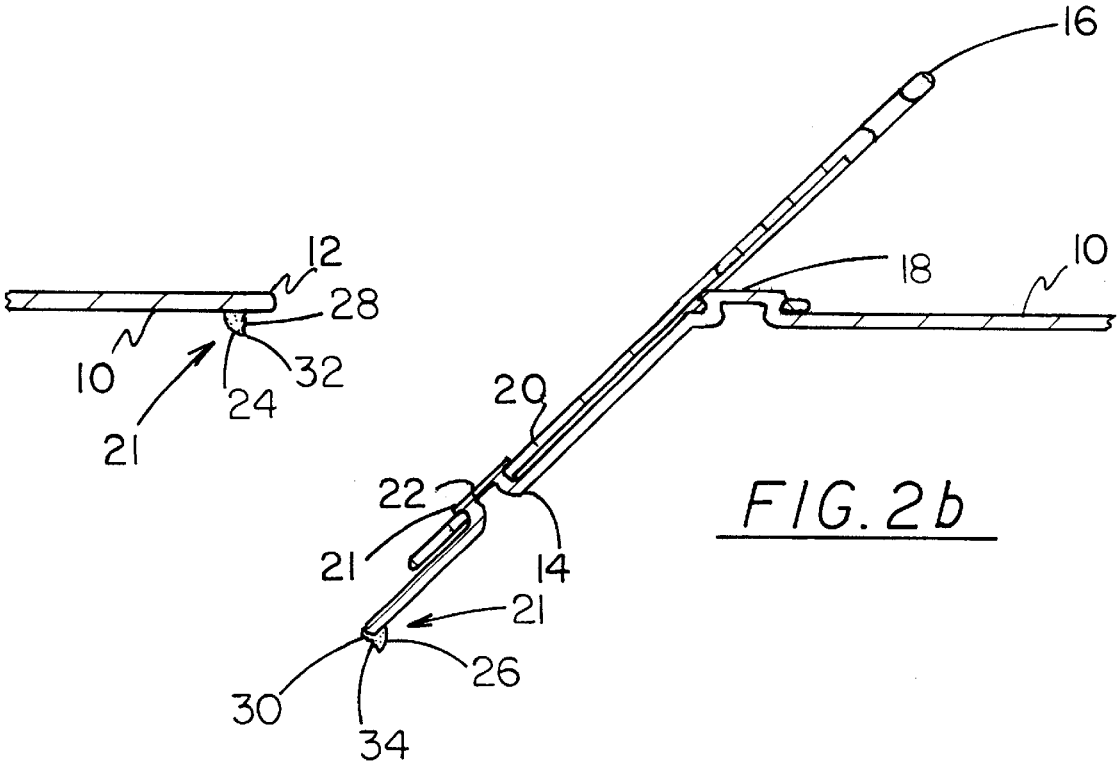
FIG. 2*b* is a cross-sectional view from a similar perspective to FIG. 2*a* but showing the plate in an open position.

With reference now to the drawings, and in particular to FIGS. 1 through 5*c* thereof, a new resealable drink can embodying the principles and concepts of the present invention and generally designated by the reference numeral 10 will be described.

Referring to the FIG. 1, the same illustrates an end plate 10 for an aluminum or steel drink can. The end plate defines an aperture 12. A closure plate 14 closes the aperture. A handle 16 is attached to the closure plate. The closure plate and handle 16 pivot about a pivot 18, located adjacent the aperture 12. The pivot preferably comprises a rivet and hole combination. The perimeter of the end plate 10 is ideally sealed to a perimeter wall of the can, such as, for example, by forming a channel along the perimeter of the end plate that receives a portion of the perimeter wall of the can and is clamped onto the portion of the perimeter wall, or by welding or the like. Such is standard in the art.

Figure 3:
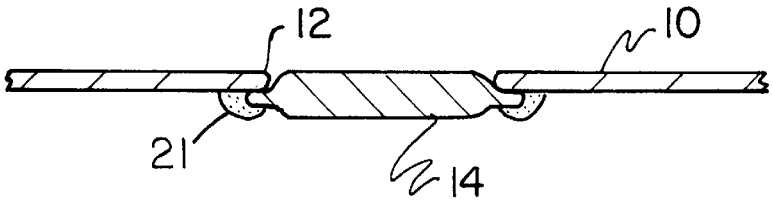
FIG. 3 is a cross-sectional view taken along line 3—3 of FIG. 1.

As can be seen from FIG. 3 and also from FIGS. 2*a* and 2*b*, the closure plate 14 is larger in area than the aperture 12 such that a perimeter portion of the closure plate abuts the underside of the end plate 10 and in particular that part of the underside which forms the perimeter of the aperture. The perimeter of the closure plate 14 is reduced in cross-section compared to the central area of the closure plate. This makes the perimeter more flexible and improves the seal where the closure plate abuts the end plate.

Significantly, an elastomeric seal 21 is provided for sealing the perimeter of the closure plate to the end plate. The elastomeric seal 21 extends across a perimeter edge of the closure plate onto an inwardly facing surface of the end plate. Critically, the elastomeric seal is frangible such that movement of the handle in an upward direction away from the end plate fractures the elastomeric seal and separates the elastomeric seal into two portions (compare FIGS. 2*a* and 2*b*). When separated, each of the portions 24, 26 of the elastomeric seal (FIG. 2*b* ) has a fracture face 28, 30

(respectively) such that the rending of the elastomeric seal produces a plurality of ridges 32, 34 (respectively) located on the fracture faces 28, 30 of each portion of the elastomeric seal. The ridges 32 of one fracture face 28 have a complementary shape to the ridges 34 of the other fracture face 30 to permit an interlocking relationship therebetween. Movement of the handle 16 downwardly toward the end plate brings the fracture faces together and interlocking the ridges of one fracture face with the ridges of the other fracture face to reseal closure plate 14 to the end plate. Interior pressure in the can (such as carbonation bubbles of gas escaping from the liquid in the can) aids in holding the closure plate in a closed position with the fracture faces interlocked.

During manufacture, the reduction in cross-sectional area of the closure plate increases the perimeter thereof by pressing, stamping or the like. Refer to FIGS. 4*a* and 4*b*. Shown in such Figures is one way to make the closure plate 14 larger than the aperture 12 that the closure plate 14 was punched out of. Another way to afford an optimal seal is to raise an area of the end plate. Note FIGS. 5*a*–*c*. FIG. 5*a* shows the raised area while FIG. 6*b* depicts the closure plate punched out and FIG. 6*c* shows the end plate 10 with the raised area 10 pressed down. It should be noted that the raised area of the end plate 10 is pressed down to make the aperture 12 smaller.

FIGS. 2*a* and 2*b* illustrate the handle 16 which is attached to the closure plate 14. The handle is pivotable about the same pivot 18 as the closure plate. The handle includes a gripping portion and a plate portion 20 which is integral with the gripping portion and extends over approximately 70% of the closure plate. The plate portion 20 is fixed to the closure plate 14 by means of a hole 21 in the plate portion 20 and a rivet 22 formed from the material of the closure plate which extends through the hole 21. However, other ways of attaching the two elements together would be possible. As shown in FIG. 1, the plate portion 20 is connected to the end plate via the rivet and is further connected to the gripping portion by way of a pair of rigid, thickened arms. By this coupling, the gripping portion and plate portion 20 of the handle constantly remain in a common plane. During operation, manipulating handle 16 thus moves closure plate 14. As shown in FIG. 2*b*, only an inboard extent of the plate portion 20 that is connected to the rivet 18 is bent during use.

As illustrated in FIGS. 2 and 3 a sealing material, typically PLASOSAL, is disposed around the perimeter of the closure plate 14 which improves the seal. In use when the end plate is used to close a beverage container, pressure in the container will force the perimeter of the plate 14 against the area of the end plate adjacent the aperture and this makes the seal safer than existing seals since an increase in pressure in the can makes the seal tighter. Prior to use, the sealing material is connected to both the closure plate and the end plate. After use, the sealing material splits into two portions as shown in FIG. 2*b* which may be abutted to recreate a comparable seal when the closure plate is closed.

The beverage container is opened by raising the handle 16 upwardly as shown in FIG. 2*b*. The container can be closed by pushing the handle back towards the end plate in the opposite direction, as shown in FIG. 2*a*, which rotates the closure plate around the pivot 18 to close the aperture 12. Any residual pressure in the can due to the carbonated beverage assists in keeping the can closed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A resealable drink can comprising:

an end plate for closing one end of a container, the end plate having an inner surface facing an interior of the container and an outer surface facing outwardly, the end plate having at least one aperture formed therein;

a closure plate mounted on the end plate for pivot movement with respect to the end plate, the closure plate being mounted on the end plate at a location adjacent to the aperture;

a handle connected to the closure plate such that movement of the handle pivots the closure plate with respect to the end plate; and an elastomeric seal extending between a perimeter portion of the closure plate and the inner surface of the end plate, the elastomeric seal being frangible such that pivot movement of the closure plate with respect to the end plate rends the elastomeric seal into two portions with each of the portions having a fracture face with a shape substantially complementary to a shape of a fracture face on the other of the portions, wherein the fracture face of one of the portions located on the closure plate is interlockable with the fracture face of one of the portions located on the end plate for forming a seal between the portions on the end plate and the closure plate.

2. The resealable drink can of claim 1 wherein the closure plate and handle lie in a substantially common plane and are rigidly connected.

3. The resealable drink can of claim 1 wherein a perimeter of the closure plate has a reduced thickness.

4. The resealable drink can of claim 1 wherein the closure plate and the handle pivot about an axis which lies in a plane which includes the end plate.

5. The resealable drink can of claim 1 wherein an area of the closure plate is larger than that of the aperture.

6. The resealable drink can of claim 1 wherein a perimeter portion of the closure plate is abuttable against an inner surface of the end plate.

7. The resealable drink can of claim 1 wherein a portion of the end plate surrounding the aperture is raised.

8. The resealable drink can of claim 1 wherein a plurality of ridges are formed on the fracture face of each portion of the elastomeric seal by the rending of the elastomeric seal, the ridges of one of the fracture faces being complementary to and interlockable with the ridges of the other fracture face.

9. A resealable drink can comprising:

an end plate for closing one end of the can, one side of the end plate defining a first surface which in use faces an inside of the container and an second surface which in use faces an outside of the end plate, the end plate further defining at least one through aperture therein;

a closure plate hinged to the end plate about a pivot located adjacent to the aperture, the closure plate being larger in area than the aperture, and being disposed on a first side of the end plate and adapted to close the aperture;

a handle which is disposed on a second side of the end plate and which is operatively connected to the closure plate such that movement of the handle moves the closure plate about the pivot; and an elastomeric seal extending between a perimeter portion of the closure plate and the inner surface of the end plate, the elastomeric seal being frangible such that pivot movement of the closure plate with respect to the end plate rends the elastomeric seal into two portions with each of the portions having a fracture face with a shape substantially complementary to a shape of a fracture face on the other of the portions, wherein the fracture face of one of the portions located on the closure plate is interlockable with the fracture face of one of the portions located on the end plate for forming a seal between the portions on the end plate and the closure plate, wherein a plurality of ridges are formed on the fracture face of each portion of the elastomeric seal by the rending of the elastomeric seal, the ridges of one of the fracture faces being complementary to and interlockable with the ridges of the other fracture face.

* * * * *